US007222502B2

(12) United States Patent
Kobayashi et al.

(10) Patent No.: US 7,222,502 B2
(45) Date of Patent: May 29, 2007

(54) EXPANSION VALVE

(75) Inventors: Kazuto Kobayashi, Tokyo (JP); Kazuhiko Watanabe, Tokyo (JP); Makoto Sudo, Tokyo (JP)

(73) Assignee: Fujikoki Corporation, Tokyo (JP)

( * ) Notice: Subject to any disclaimer, the term of this patent is extended or adjusted under 35 U.S.C. 154(b) by 198 days.

(21) Appl. No.: 11/044,270

(22) Filed: Jan. 28, 2005

(65) Prior Publication Data

US 2005/0178152 A1 Aug. 18, 2005

(30) Foreign Application Priority Data

Feb. 13, 2004 (JP) ..... 2004-036866

(51) Int. Cl.
*F25B 41/06* (2006.01)

(52) U.S. Cl. ..... 62/527

(58) Field of Classification Search ..... 62/210, 62/222, 527; 236/92 B

See application file for complete search history.

(56) References Cited

U.S. PATENT DOCUMENTS 5,228,619 A * 7/1993 Yano et al. ..... 236/92 B
5,596,881 A 1/1997 Wilson et al.
5,931,377 A 8/1999 Kang et al.
6,532,753 B2 * 3/2003 Watanabe et al. ..... 62/115
6,626,365 B2 * 9/2003 Kobayashi et al. ..... 236/92 B
6,626,370 B2 * 9/2003 Yano et al. ..... 236/92 B
6,655,601 B2 * 12/2003 Yano et al. ..... 236/92 B
6,712,281 B2 * 3/2004 Hirota et al. ..... 236/92 B
6,758,055 B2 * 7/2004 Watanabe et al. ..... 62/225
6,848,624 B2 * 2/2005 Dianetti et al. ..... 236/92 B
6,868,684 B2 * 3/2005 Law et al. ..... 62/225
6,895,993 B2 * 5/2005 Kobayashi et al. ..... 137/454.6
6,935,573 B2 * 8/2005 Kobayashi et al. ..... 236/92 B
2001/0027662 A1 10/2001 Yano

FOREIGN PATENT DOCUMENTS

JP 10-325479 12/1998
JP 2000-241048 A * 9/2000
JP 2000-304381 A 11/2000

* cited by examiner

*Primary Examiner*—Mohammad M. Ali
(74) *Attorney, Agent, or Firm*—Rader, Fishman & Grauer PLLC

(57) ABSTRACT

The invention provides an improved structure for assembling components in an expansion valve used in air conditioners. An expansion valve body 30 has a valve chamber 35 and a passage 32 through which refrigerant from a compressor enters. The refrigerant passing through a flow path between a valve means 32*b* and an orifice 32*a* is sent through a passage 321 toward an evaporator. The refrigerant returning from the evaporator passes through a passage 34 and flows toward the compressor. A power element 36 operates the valve means 32*b* in response to the thermal load of the evaporator and controls the flow rate of refrigerant. The lower end of a spring 32*d* disposed within the valve chamber 35 and biasing the valve means 32*b* toward the orifice 32*a* is supported by a sealing member 150 that is inserted to an opening 35*a* of the valve chamber and fixed to position via a crimping portion $K_1$.

4 Claims, 4 Drawing Sheets

EXPANSION VALVE

The present application is based on and claims priority of Japanese patent application No. 2004-36866 filed on Feb. 13, 2004, the entire contents of which are hereby incorporated by reference.

BACKGROUND OF THE INVENTION

1. Field of the Invention

The present invention relates to an expansion valve equipped in an air conditioner of a car or the like for controlling the flow of refrigerant supplied to an evaporator according to the temperature of the refrigerant.

2. Description of the Related Art

This type of expansion valve is disclosed for example in the following patent document, Japanese Patent Application Laid-Open Publication No. 2000-304381.

The prior art expansion valve included a valve receive member, a spring, an adjustment screw and so on, which required a large number of components, so it was difficult to achieve the desired reduction in weight and size of the expansion valve.

Furthermore, there was fear that the refrigerant might leak from the valve chamber through the adjustment screw portion.

SUMMARY OF THE INVENTION

In view of the above drawbacks, the present invention aims at answering to the demands for reducing the size and weight of the car air conditioner by providing an expansion valve having a simplified structure and therefore requiring less assembling steps.

The expansion valve according to the present invention comprises a valve body, a power element portion disposed on an upper end of the valve body for actuating a valve means in response to a displacement of a diaphragm, and a spring disposed within a valve chamber formed to a lower end of the valve body for adjusting a valve opening of the valve means, wherein the spring is supported by a sealing member inserted to an opening of the valve chamber and fixed to the valve body via a crimping portion. The expansion valve further has a stepped portion formed to the opening of the valve chamber in the valve body, and the sealing member is inserted to the stepped portion and fixed to position via the crimping portion.

Moreover, the sealing member can be equipped with a tapered surface that is pressed against the stepped portion of the valve chamber, or with a seal fit to an outer circumference thereof.

DETAILED DESCRIPTION OF THE PREFERRED EMBODIMENTS

Figure 1:
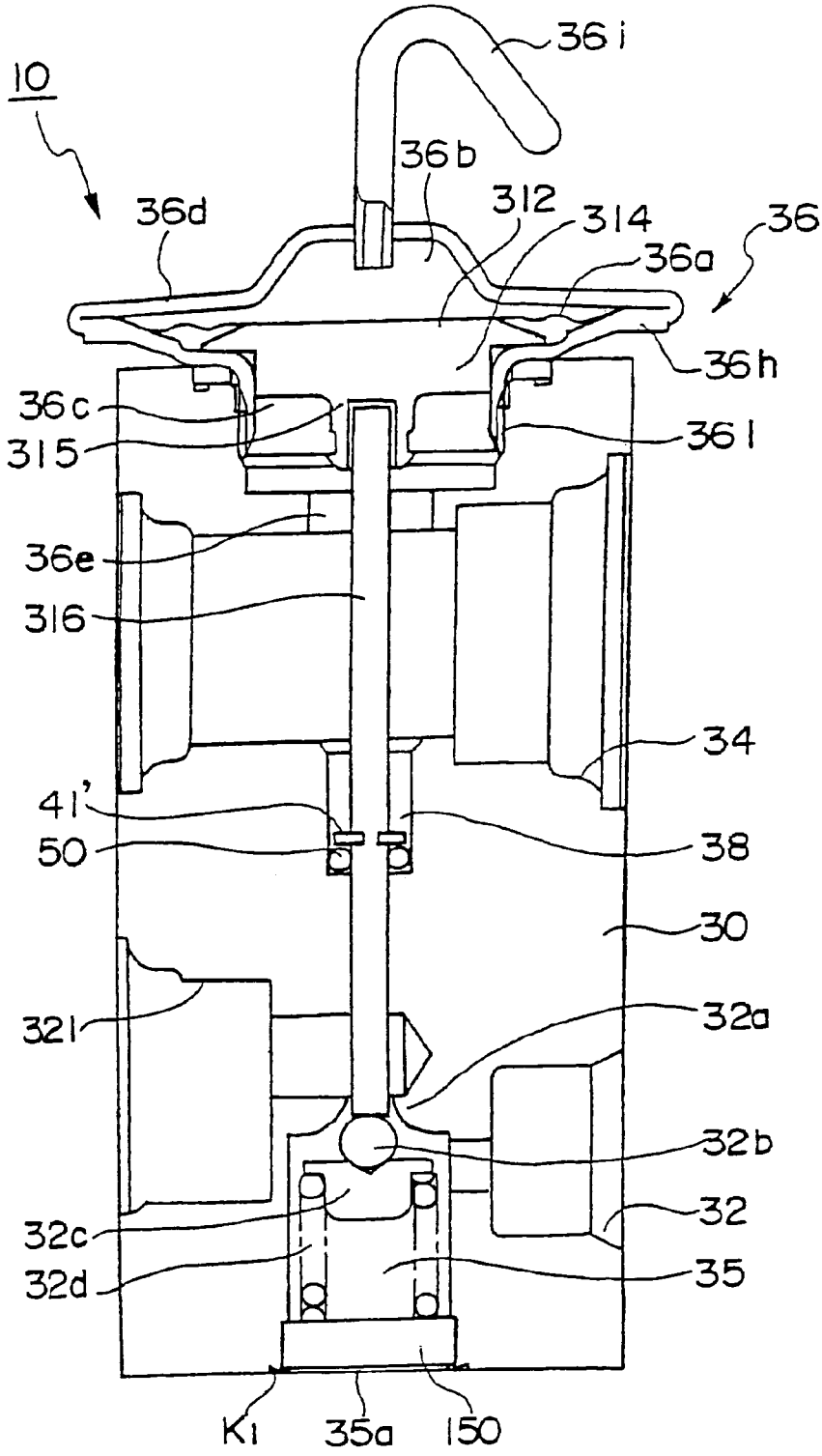
FIG. 1 is a cross-sectional view of an expansion valve according to the present invention.

FIG. 1 is a cross-sectional view showing an expansion valve according to the present invention.

The expansion valve, the whole of which being denoted by a reference number 10, has a rectangular column shaped valve body 30 made of an aluminum alloy, which includes a passage 32 for the refrigerant flowing in from the receiver toward the evaporator. Passage 32 communicates via a valve chamber 35 and an orifice 32*a* to an outlet port 321 opening toward the evaporator.

A spherical valve means 32*b* is supported on a supporting member 32*c* inside the valve chamber 35. A sealing member 150 is inserted to an opening 35*a* of the valve chamber 35, and a coil spring 32*d* is disposed between the sealing member 150 and the supporting member 32*c* of the valve means 32*b* fixed to position by a crimping portion $K_1$ providing fixing via crimping, the coil spring biasing the valve means 32*b* toward the orifice 32*a*.

The refrigerant returning from the evaporator is sent toward the compressor through a passage 34.

A power element portion 36 for actuating the valve means is attached to the upper portion of the valve body 30.

The power element portion 36 has an upper cover 36*d* and a lower cover 36*h*, between which a diaphragm 36*a* is sandwiched. An upper pressure actuated chamber 36*b* is formed between the diaphragm 36*a* and the upper cover 36*d*, which is filled by an actuating gas through a tube 36*i*.

The lower surface of the diaphragm 36*a* is supported by a stopper member 312. The stopper member 312 has a large diameter portion 314 and a small diameter portion 315, between which a lower pressure actuated chamber 36*c* is formed.

The lower cover portion 36*h* is fixed to the valve body 30 through a screw thread portion 361.

The lower pressure actuated chamber 36*c* is communicated with passage 34 via an opening 36*e*.

The actuating rod 316 inserted to the small diameter portion 315 of the stopper member 312 also functions as a heat sensing rod for transmitting the refrigerant temperature via the stopper member 312 to the upper pressure actuated chamber 36*b*.

The actuating rod 316 is passed through the center of the valve body 30 and actuates the valve means 32*b*. A seal member 50 attached to the actuating rod 316 is inserted to a bore 38 that communicates with passage 34.

A snap ring 41' is used to restrict movement.

This sealing mechanism enables the refrigerant traveling toward the evaporator and the refrigerant returning from the evaporator to be separated completely.

The expansion valve 10 of the present invention is composed as described above, and by the operation of the power element portion 36, the opening of the refrigerant passage between the valve means 32*b* and the orifice 32*a* is controlled so as to control the flow of refrigerant.

Figure 2:
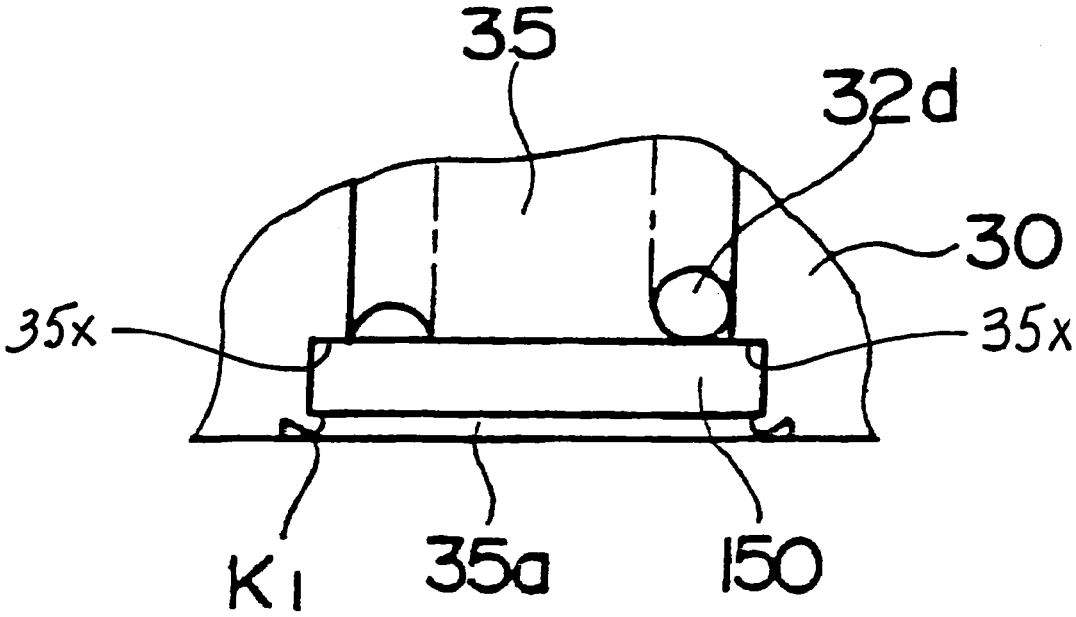
FIG. 2 is an enlarged view of the relevant portion of FIG. 1.

FIG. 2 is an enlarged view showing the structure for attaching the sealing member 150 to the valve chamber 35 of FIG. 1.

The sealing member 150 has a flat surface. An opening 35*a* of the valve chamber 35 formed to the valve body 30 has a stepped portion 35*x* formed between the valve chamber 35. By pushing the sealing member 150 into the opening 35*a* via the crimping portion $K_1$, a tight seal is formed with the stepped portion.

Figure 3:
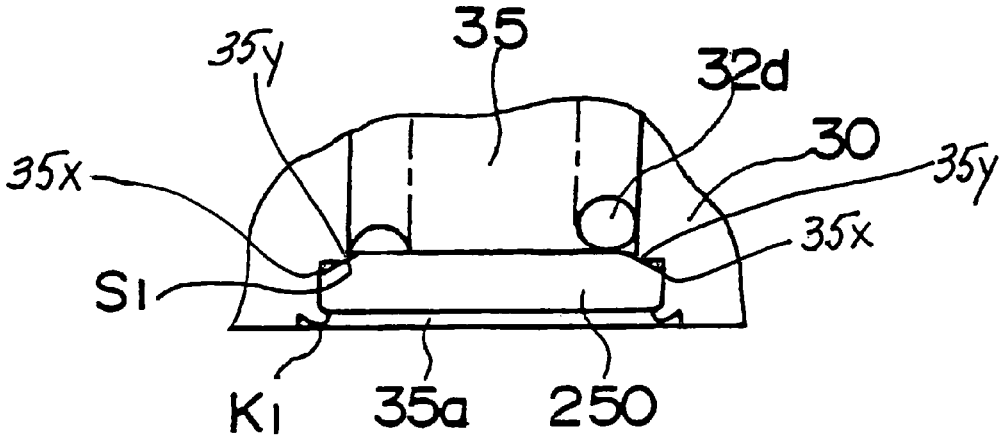
FIG. 3 is an explanatory view showing another embodiment of the present invention.

FIG. 3 is an explanatory view showing another embodiment of the present invention.

A sealing member 250 has a tapered surface 35*y* formed to the upper surface thereof. An opening 35*a* of the valve chamber 35 formed to the valve body 30 has the stepped portion 35*x* formed between the valve chamber 35. By pushing the sealing member 250 into the opening 35*a* via the crimping portion $K_1$, a tight seal $S_1$ is formed with the stepped portion 35*x*.

Figure 4:
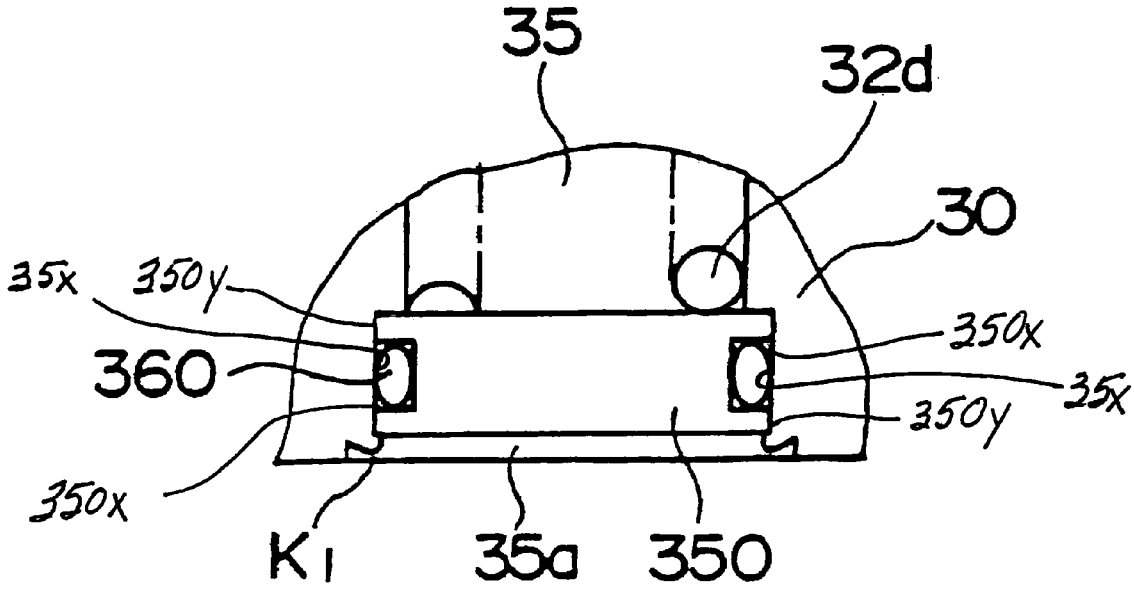
FIG. 4 is an explanatory view showing yet another embodiment of the present invention.

FIG. 4 is an explanatory view showing yet another embodiment of the present invention.

A sealing member 350 has a seal 360 mounted to the outer circumference thereof. The sealing member 350 is fit to the opening 35*a* of the valve chamber 35 via the crimping portion $K_1$. The sealing member 350 includes a circumferential groove 350*x* formed radially into a circumferential surface 350*y* of the sealing member 350. The seal 360 is sized to be received by the circumferential groove 350*x* in a close-fitting manner such that, when the sealing member 350 with the seal 360 received by the circumferential groove 350*x* is fixed to the valve body 30, the seal 360 contacts a circumferential inner wall surface 35*x* of the valve chamber 35. An even more reliable seal is achieved by providing the seal 360.

What is claimed is:

1. An expansion valve comprising:

a valve body;

a power element portion disposed on an upper end of the valve body for actuating a valve means in response to a displacement of a diaphragm; and a spring disposed within a valve chamber formed to a lower end of the valve body for adjusting a valve opening of the valve means, the valve chamber having an opening formed thereinto, the opening being defined by a circumferential edge portion of the valve body at the lower end of the valve body, wherein the spring is supported by a sealing member inserted into the valve chamber and the sealing member is fixed to the valve body by crimping the circumferential edge portion.

2. The expansion valve according to claim 1, further having a stepped portion formed to the opening of the valve chamber in the valve body, and the sealing member is inserted to the stepped portion and fixed to position via the crimping portion.

3. The expansion valve according to claim 2, wherein the sealing member has a tapered surface that is pressed against the stepped portion of the valve chamber.

4. The expansion valve according to claim 2, further comprising a seal, wherein the sealing member includes a circumferential groove formed radially into a circumferential surface of the sealing member, the seal being sized to be received by the circumferential groove in a close-fitting manner such that, when the sealing member with the seal received by the circumferential groove is fixed to the valve body, the seal contacts a circumferential inner wall surface of the valve chamber.

* * * * *